US009149066B2

(12) United States Patent
Scott et al.

(10) Patent No.: US 9,149,066 B2
(45) Date of Patent: Oct. 6, 2015

(54) APPARATUS FOR STRIPPING AND SORTING LEAVES FROM AGRICULTURAL CROPS

(75) Inventors: C. Regan Scott, Midlothian, VA (US); Curtis M. Hinton, Glen Allen, VA (US); Ty Murray, Midlothian, VA (US); Martin Heidorn, Chesterfield, VA (US)

(73) Assignee: Altria Client Services LLC., Richmond, VA (US)

( * ) Notice: Subject to any disclaimer, the term of this patent is extended or adjusted under 35 U.S.C. 154(b) by 481 days.

(21) Appl. No.: 13/526,094

(22) Filed: Jun. 18, 2012

(65) Prior Publication Data

US 2012/0329536 A1 Dec. 27, 2012

Related U.S. Application Data

(60) Provisional application No. 61/498,410, filed on Jun. 17, 2011.

(51) Int. Cl.

| | |
|---|---|
| ***A24B 5/06*** | (2006.01) |
| ***A24B 5/00*** | (2006.01) |
| ***A24B 5/02*** | (2006.01) |

(52) U.S. Cl.
CPC .... *A24B 5/00* (2013.01); *A24B 5/02* (2013.01)

(58) Field of Classification Search
CPC ..... A23N 15/01; A24B 5/00; A24B 5/06; A24B 5/12
USPC ..... 460/134–140; 131/313, 319–320, 322
See application file for complete search history.

(56) References Cited

U.S. PATENT DOCUMENTS

| | | | | | |
|---|---|---|---|---|---|
| 38,114 | A | * | 4/1863 | Mancy | 100/91 |
| 754,788 | A | * | 3/1904 | Luce | 460/136 |
| 928,149 | A | * | 7/1909 | Peters | 460/140 |
| 1,491,070 | A | * | 4/1924 | Scranton | 460/136 |
| 1,557,113 | A | * | 10/1925 | Scranton | 460/136 |
| 3,045,679 | A | * | 7/1962 | Kibinger et al. | 460/135 |
| 4,836,220 | A | * | 6/1989 | Miyake et al. | 460/130 |

* cited by examiner

*Primary Examiner* — Alicia Torres
(74) *Attorney, Agent, or Firm* — Roberts Mlotkowski Safran & Cole, P.C.

(57) ABSTRACT

An apparatus for stripping and sorting leaves from stalks of agricultural crops. The apparatus includes a base frame having a first longitudinal member, the first longitudinal member having a first end and a second end, and a second longitudinal member in a parallel spaced-relationship with the first longitudinal member, a plurality of cross members arranged perpendicularly along at least the first longitudinal member, each of the plurality of cross members having a lower stripping member for receiving the stalk of an agricultural crop, a plurality of upper stripping members, each upper stripping member positionable to cooperate with a corresponding lower stripping member to substantially encircle the stalk and stalk gripping assembly for engaging and conveying the stalk along the apparatus in a direction from the first end to the second end of the first longitudinal member.

17 Claims, 6 Drawing Sheets

APPARATUS FOR STRIPPING AND SORTING LEAVES FROM AGRICULTURAL CROPS

This application claims priority to U.S. Provisional Application No. 61/498,410, filed on Jun. 17, 2011, the contents of which are hereby incorporated by reference in their entirety.

FIELD

The present invention generally relates to an apparatus for stripping and sorting leaves from stalks of agricultural crops, and more particularly to an apparatus for stripping and sorting tobacco leaves from stalks.

Environment

Many agricultural crops, such as tobacco, have been manually harvested for centuries. Burley tobacco is often harvested by cutting the entire stalk and curing the leaves while attached to the stalk. The cut tobacco plants are allowed to wilt in the sun for a day or so to reduce the amount of bruising and breaking of the tobacco leaves as the plant is handled. Then, the plants are speared with a stick and hung in a curing or drying barn.

Attempts have been made to develop automated or semi-automated leaf strippers. In certain of these devices, it is common for the tobacco stalks engaged thereby to bend and deflect during the harvesting operation. Sometimes the bending and deflection of the stalks actually results in the stalks being broken or severely damaged. Of equal concern is that the effectiveness of the leaf strippers is impaired by the instability or movement of the stalks during stripping. In such cases, the tobacco leaves may not be cleanly stripped from the stalk or the leaves may not even be removed at all.

Despite advances in the art, there is still a need for an apparatus for stripping and sorting leaves from stalks of agricultural crops.

SUMMARY

Provided herewith is an apparatus for stripping and sorting leaves from stalks of agricultural crops. The apparatus includes a base frame having a first longitudinal member, the first longitudinal member having a first end and a second end, and a second longitudinal member in a parallel spaced-relationship with the first longitudinal member, a plurality of cross members arranged perpendicularly along at least the first longitudinal member, each of the plurality of cross members having a lower stripping member for receiving the stalk of an agricultural crop, a plurality of upper stripping members, each upper stripping member positionable to cooperate with a corresponding lower stripping member to substantially encircle the stalk and means for engaging and conveying the stalk along the apparatus in a direction from the first end to the second end of the first longitudinal member, wherein each upper stripping member and the corresponding lower stripping member cooperate to strip the leaves from the stalk as the stalk is conveyed along the apparatus.

In one form, the means for engaging and conveying the stalk along the apparatus comprises a stalk gripping assembly disposed near the second end of the first longitudinal member, the stalk gripping assembly including cooperative first and second drive belts disposed in a side-by-side relationship to form a v-configuration.

In another form, the innermost segments of the belts are disposed adjacent each other to cooperate and receive the stalk therebetween.

In yet another form, the apparatus includes a pair of splined rollers to receive the tip of the stalk therebetween.

In still yet another form, the apparatus includes a conveyor assembly disposed near the second end of the first longitudinal member, the conveyer assembly comprising a pair of rollers and an endless belt operatively encircling the rollers, the conveyor assembly connected to the base frame and effective to convey the stalk parallel to the second end of the first longitudinal member.

In a further form, the apparatus includes a pivotable frame, the pivotable frame having the plurality of upper stripping members affixed thereto. the pivotable frame capable of pivoting from an open position to a closed position.

In a yet further form, the means for engaging and conveying the stalk along the apparatus is initiated by placing the pivotable frame in the closed position.

In a still yet further form, the apparatus includes a plurality of dividers perpendicularly disposed along the first and second longitudinal members, the plurality of dividers effective to sort leaves by position along the stalk.

In another aspect, provided is a method for stripping and sorting leaves from stalks of agricultural crops. The method includes the steps of placing a stalk upon a plurality of lower stripping members of an apparatus for stripping and sorting leaves from the stalks of agricultural crops, positioning a plurality of upper stripping members so as to cooperate with a corresponding lower stripping member to substantially encircle the stalk, engaging and conveying the stalk longitudinally along the apparatus, stripping the leaves from the stalk as the stalk is conveyed along the apparatus, and sorting the leaves by position along the stalk as the stalk is conveyed along the apparatus.

BRIEF DESCRIPTION OF THE DRAWINGS

The forms disclosed herein are illustrated by way of example, and not by way of limitation, in the figures of the accompanying drawings and in which like reference numerals refer to similar elements and in which.

DETAILED DESCRIPTION

Figure 1:
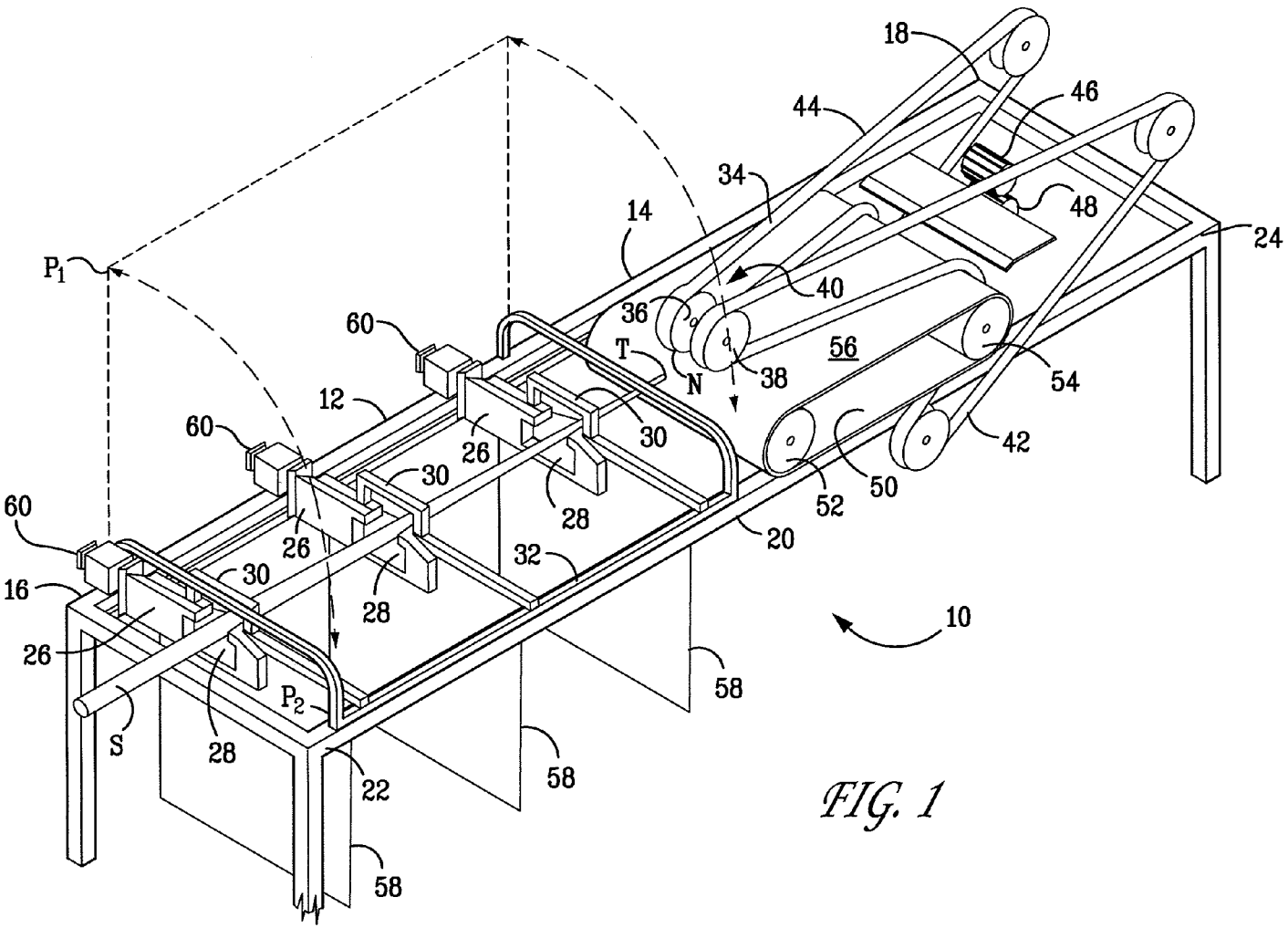
FIG. 1 presents a simplified perspective view of an apparatus for stripping and sorting leaves from the stalks of agricultural crops, in accordance herewith.

Various aspects will now be described with reference to specific forms selected for purposes of illustration. It will be appreciated that the spirit and scope of the apparatus and methods disclosed herein are not limited to the selected forms. Moreover, it is to be noted that the figures provided herein are not drawn to any particular proportion or scale, and that many variations can be made to the illustrated forms. Reference is now made to FIGS. 1-9, wherein like numerals are used to designate like elements throughout.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "having," "comprises," and "comprising," and, their linguistic or grammatical variants, derivatives, and/or conjugates, as used herein, means "including, but not limited to."

Throughout the illustrative description, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

FIG. 1 presents a simplified perspective view of an apparatus for stripping and sorting leaves from stalks of agricultural crops 10, in accordance herewith. As shown, the apparatus for stripping and sorting leaves from stalks of agricultural crops 10, includes a base frame 12 having a first longitudinal member 14, the first longitudinal member 14 having a first end 16 and a second end 18. Base frame 12 also includes a second longitudinal member 20 in a parallel spaced-relationship with the first longitudinal member 14. Second longitudinal member 20 includes a first end 22 and a second end 24.

A plurality of cross members 26 are arranged perpendicularly along at least first longitudinal member 14. Each of the plurality of cross members 26 has a lower stripping member 28 for receiving a stalk S (stalk position) of an agricultural crop. Also, as shown in FIG. 1, a plurality of upper stripping members 30 is provided. Each upper stripping member 30 is positionable to cooperate with a corresponding lower stripping member 28 to form a stripper ring and substantially encircle the stalk S. Upper stripping members 30 may be affixed to a pivotable frame 32, the pivotable frame 32 being moveable from an open position P1 to a closed position P2, as indicated in FIG. 1.

Still referring to FIG. 1, means for engaging and conveying 34 a stalk S along the apparatus 10 is provided. In one form, the means for engaging and conveying 34 engages tip T of stalk S via a stalk gripping assembly 40 at a nip point N formed by a first V-belt driven wheel 36 and a second V-belt driven wheel 38. Upon engagement, stalk S is conveyed along apparatus 10 in a direction from first end 16 to second end 18 of first longitudinal member 14. As may be appreciated, when stalk S includes a plurality of leaves along its length, each upper stripping member 30 and its corresponding lower stripping member 28 cooperate to strip the leaves from stalk S as stalk S is conveyed along the apparatus. In one form, stalk gripping assembly 40 disposed near second end 18 of first longitudinal member 14, the stalk gripping assembly 40 including cooperative first and second drive belts 42 and 44, disposed in a side-by-side relationship to form a v-configuration. When configured in this manner, the respective innermost segments of the drive belts 42 and 44 are disposed adjacent each other to cooperate and receive the stalk S therebetween.

In one form, means for engaging and conveying 34 further includes a first splined roller 46 and a second splined roller 48, the pair of splined rollers disposed so as to cooperate and receive the tip T of stalk S therebetween. Advantageously, when a tobacco plant, such as a burley tobacco plant is employed, first splined roller 46 and second splined roller 48 may serve to sever the tip T from the rest of stalk, separating the tip leaves from the remainder of the plant.

In one form, apparatus 10 includes a conveyor assembly 50 disposed near second end 18 of first longitudinal member 14. Conveyer assembly includes a first roller 52, a second roller 54 and an endless belt 56 operatively encircling the pair of rollers 52 and 54. As shown in FIG. 1, conveyor assembly 50 is operatively connected to base frame 12 and effective to convey the stalk S parallel to first longitudinal member 14.

Means for engaging and conveying 34 may be motor driven, the motor initiated by placing pivotable frame 32 in closed position P2. Each upper stripping member 30 and its corresponding lower stripping member 28 serve to form a stripping ring. As the stalk is conveyed wrap reach stripping ring is effective to tear the leaves of the agricultural product off the stalk S.

As is the case with a tobacco plant, the leaves along stalk S have different properties owing to the amount of sun each may receive and may also differ in size, with the largest leaves forming along the bottom of the plant. Advantageously, apparatus 10 may also include a plurality of dividers 58 perpendicularly disposed along first and second longitudinal members 14 and 20, the plurality of dividers 58 effective to sort leaves by position along the stalk S. To better sort leaves by position along stalk S, one or more of the plurality of cross members 26 may be made to be longitudinally positionable along first and/or second longitudinal members 14 and/or 20 through the use of clamping mechanisms 60.

Referring now to FIGS. 2-9 another form of an apparatus for stripping and sorting leaves from stalks of agricultural crops 100 is shown. As shown, the apparatus for stripping and sorting leaves from stalks of agricultural crops 100, includes a base frame 112 having a first longitudinal member 114, the first longitudinal member 114 having a first end 116 and a second end 118. Base frame 112 also includes a second longitudinal member 120 in a parallel spaced-relationship with the first longitudinal member 114. Second longitudinal member 120 includes a first end 122 and a second end 124.

A plurality of cross members 126 are arranged perpendicularly along at least first longitudinal member 114. Each of the plurality of cross members 126 has a lower stripping member 128 for receiving a stalk S of an agricultural crop. Also, as shown best in FIG. 3, a plurality of upper stripping members 130 is provided. Each upper stripping member 130 is positionable to cooperate with a corresponding lower stripping member 128 to form a stripper ring and substantially encircle the stalk S. Upper stripping members 130 is affixed to a pivotable frame 132, the pivotable frame 132 being moveable from an open position to a closed position, as was the case of the FIG. 1 form.

Figure 3:
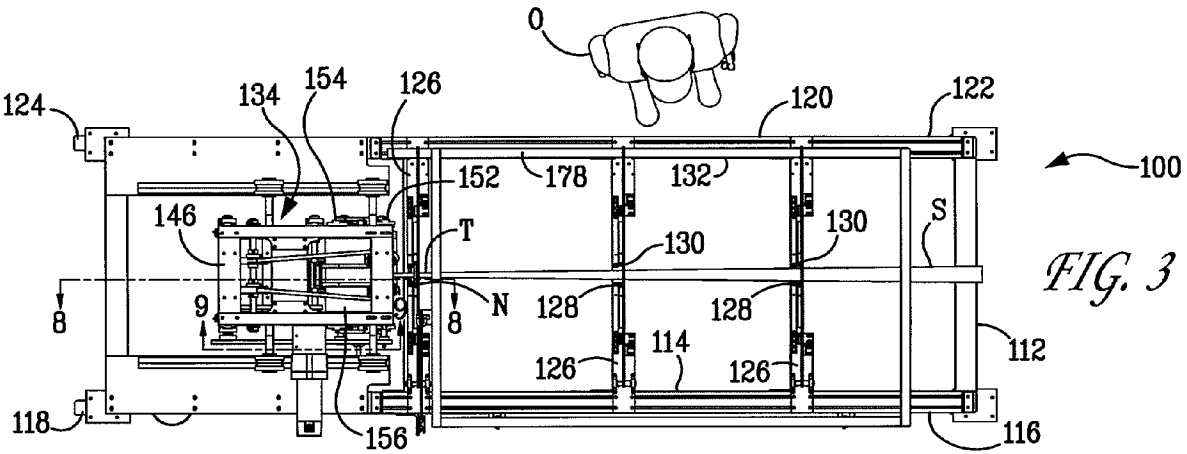
FIG. 3 presents a top view of the FIG. 2 form of the apparatus for stripping and sorting leaves from stalks of agricultural crops, in accordance herewith.
Figure 5:
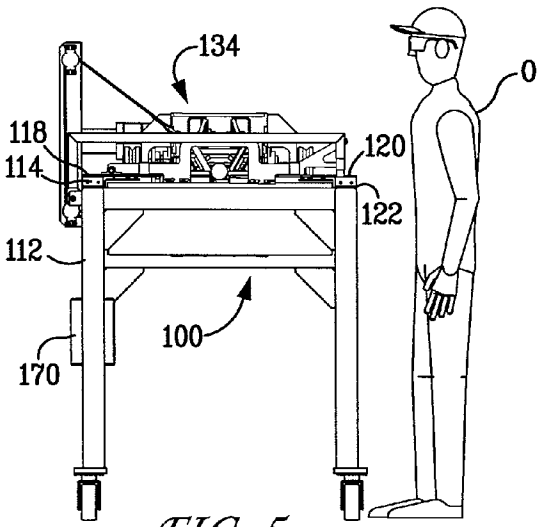
FIG. 5 presents an opposing end view of the FIG. 2 form of the apparatus for stripping and sorting leaves from stalks of agricultural crops, in accordance herewith.
Figure 4:
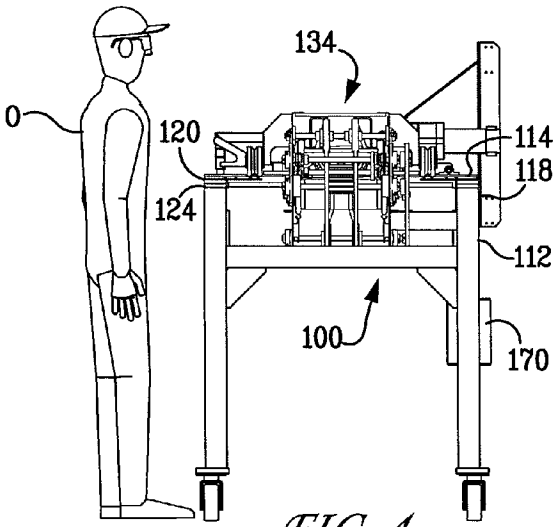
FIG. 4 presents an end view of the FIG. 2 form of the apparatus for stripping and sorting leaves from stalks of agricultural crops, in accordance herewith.
Figure 7:
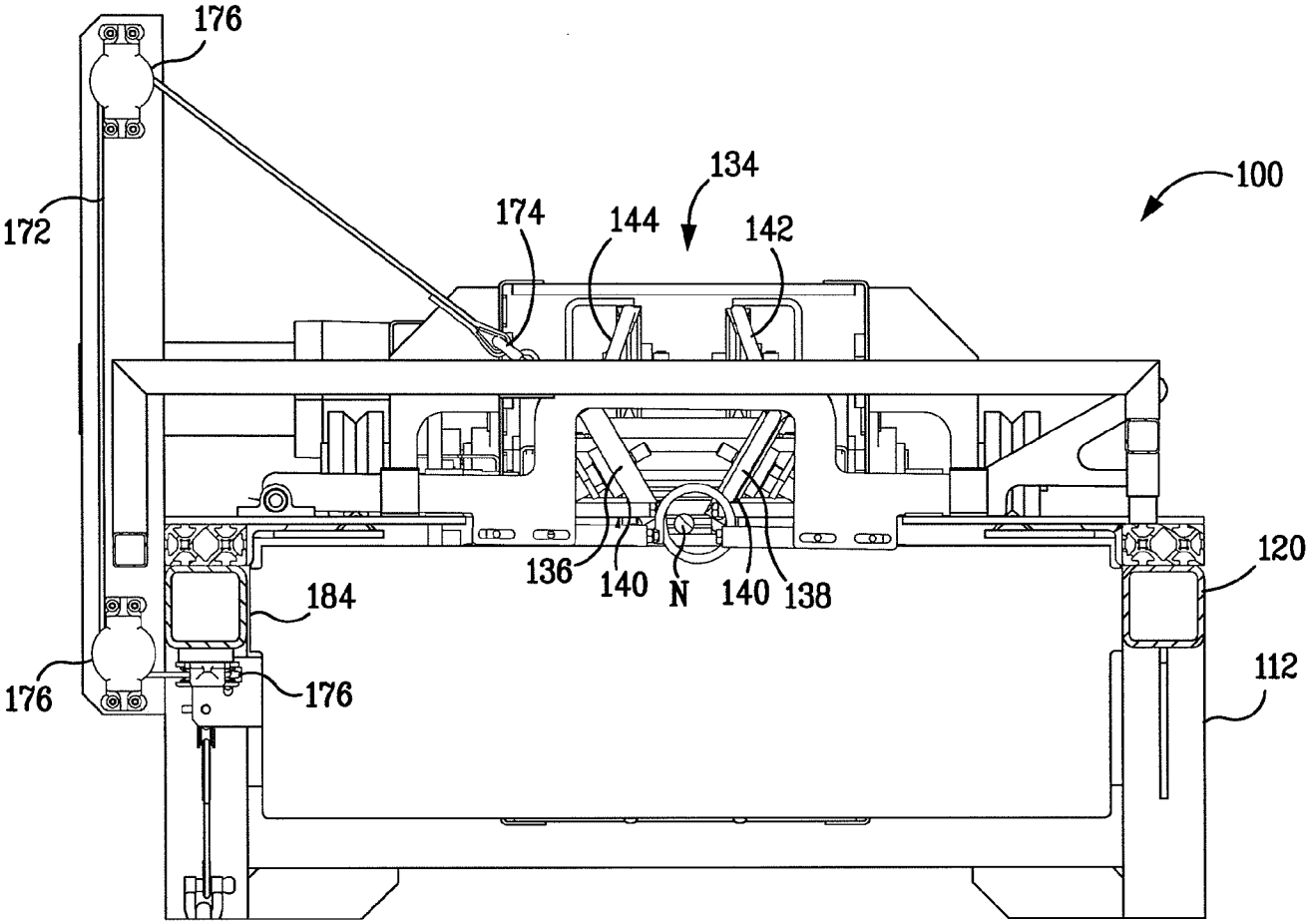
FIG. 7 presents a sectional view of the apparatus for stripping and sorting leaves from stalks of agricultural crops, taken along line 7-7 of FIG. 2, in accordance herewith.
Figure 8:
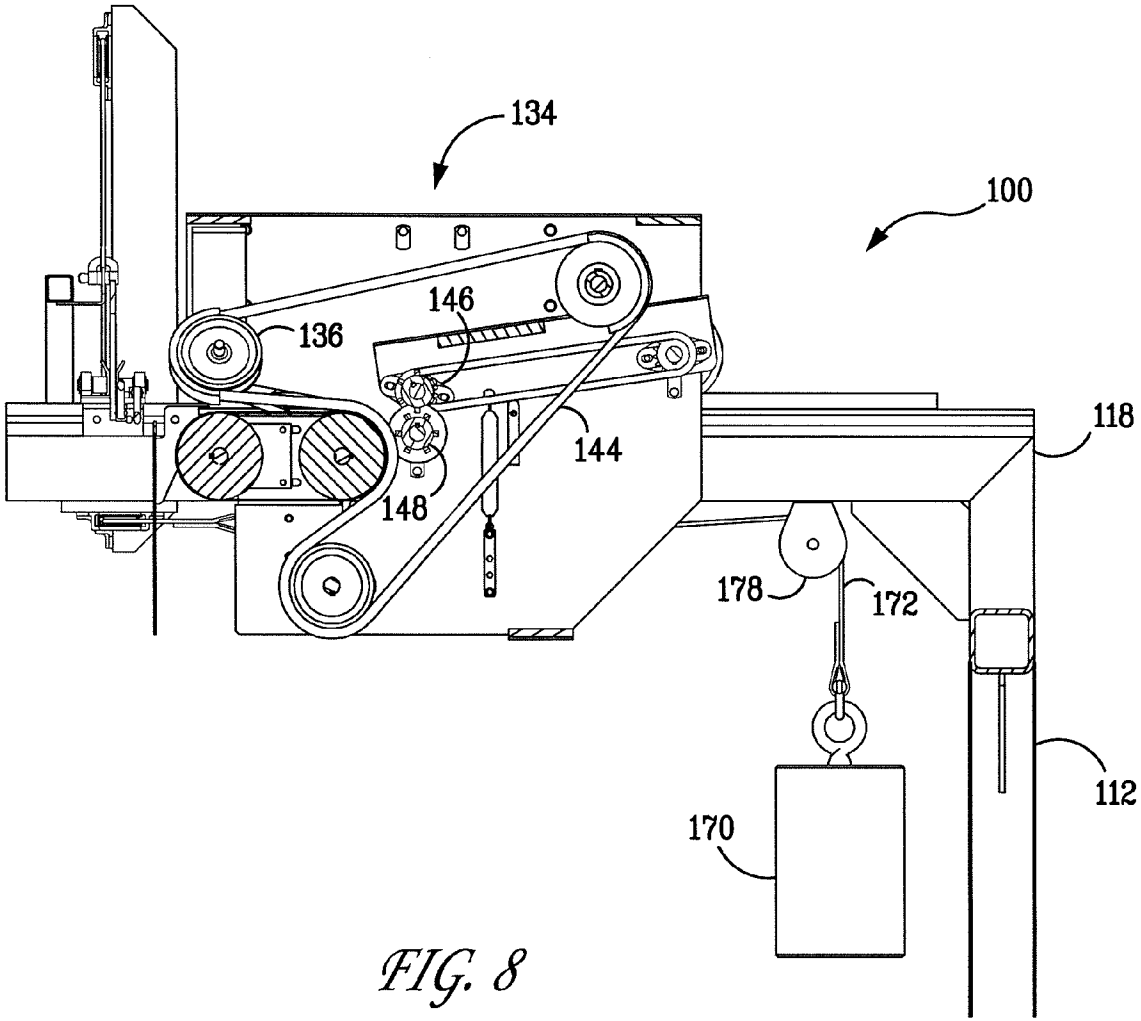
FIG. 8 presents a sectional view of the apparatus for stripping and sorting leaves from stalks of agricultural crops, taken along line 8-8 of FIG. 3, in accordance herewith.

Means for engaging and conveying 134 a stalk S along the apparatus 10 is provided. Referring to FIGS. 3 and 7, the means for engaging and conveying 134 engages tip T of stalk S via a stalk gripping assembly 140 at a nip point N formed by a first V-belt driven wheel 136 and a second V-belt driven wheel 138. Upon engagement, stalk S is conveyed along apparatus 100 in a direction from first end 116 to second end 118 of first longitudinal member 114.

As with the FIG. 1 form, when stalk S includes a plurality of leaves along its length, each upper stripping member 130 and its corresponding lower stripping member 128 cooperate to strip the leaves from stalk S as stalk S is conveyed along the apparatus. In one form, stalk gripping assembly 140 is disposed near second end 118 of first longitudinal member 114, the stalk gripping assembly 140 including cooperative first and second drive belts 142 and 144, disposed in a side-by-side relationship to form a V-configuration. When configured in this manner, the respective innermost segments of the drive belts 142 and 144 are disposed adjacent each other to cooperate and receive the stalk S therebetween.

Figure 6:
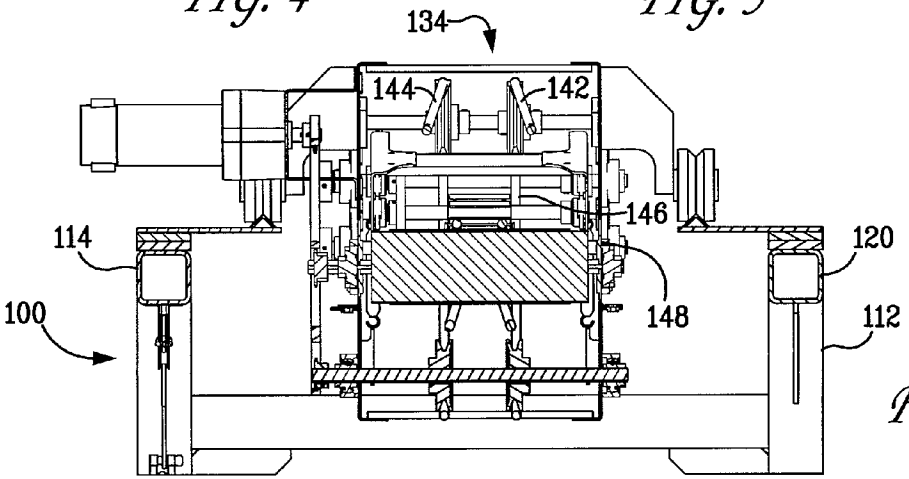
FIG. 6 presents a sectional view of the apparatus for stripping and sorting leaves from stalks of agricultural crops, taken along line 6-6 of FIG. 2, in accordance herewith.

Referring to FIGS. 3 and 6, means for engaging and conveying 134 further includes a first splined roller 146 and a second splined roller 148, the pair of splined rollers disposed so as to cooperate and receive the tip T of stalk S therebetween. Advantageously, when a tobacco plant, such as a burley tobacco plant is employed, first splined roller 146 and second splined roller 148 may serve to sever the tip T from the rest of stalk, separating the tip leaves from the remainder of the plant.

Figure 9:
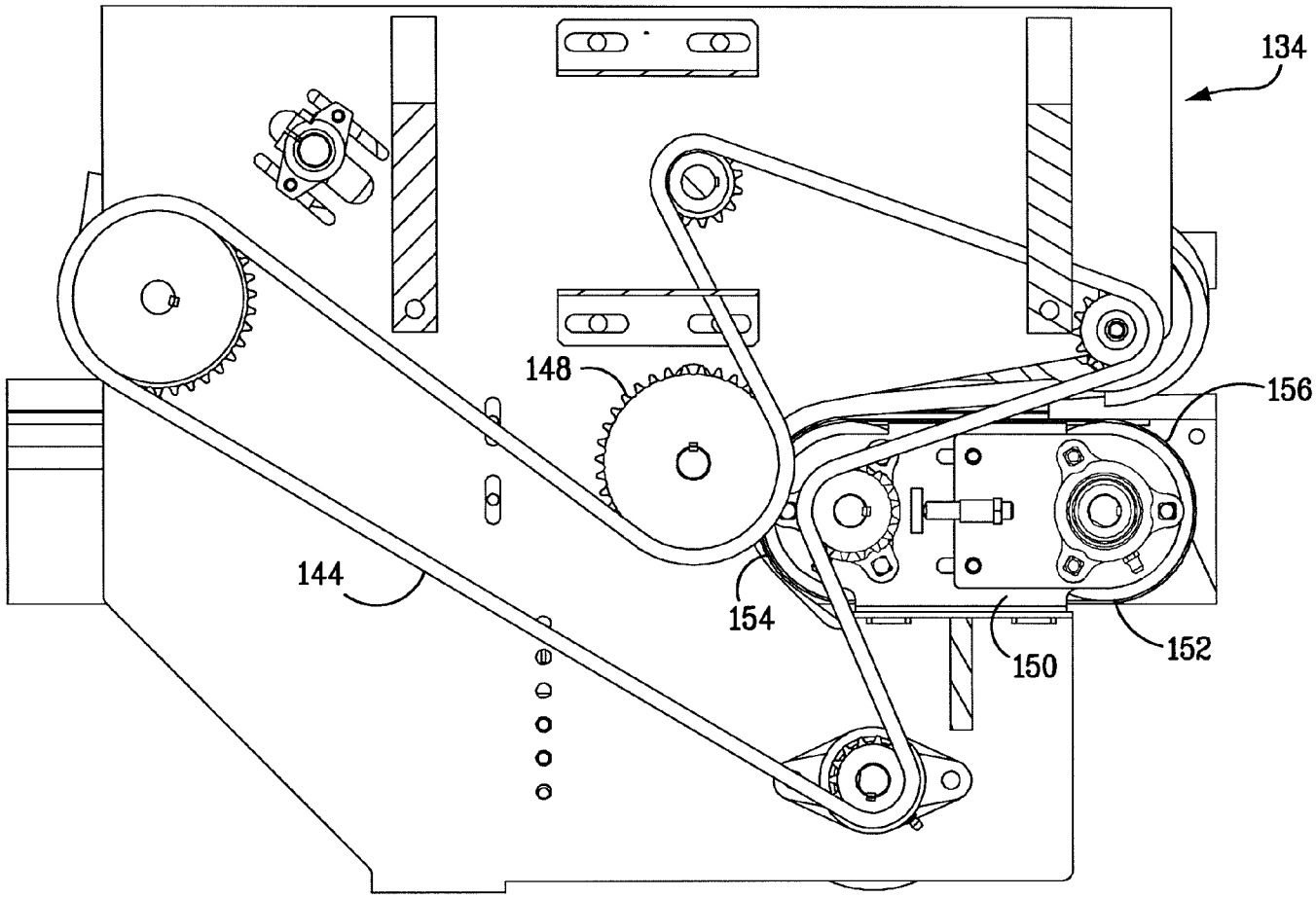
FIG. 9 presents a sectional view of the apparatus for stripping and sorting leaves from stalks of agricultural crops, taken along line 9-9 of FIG. 3, in accordance herewith.

Referring to FIGS. 3 and 9, apparatus 100 includes a conveyor assembly 150 disposed near second end 118 of first longitudinal member 114. Conveyer assembly includes a first roller 152, a second roller 154 and an endless belt 56 operatively encircling the pair of rollers 152 and 154.

The means for engaging and conveying 134 may be motor driven, the motor initiated by placing pivotable frame 132 in closed position. The motor may be selected from among conventional AC or DC electric motors having a power rating of between one-quarter to three-quarter horsepower.

Each upper stripping member 130 and its corresponding lower stripping member 128 serve to form a stripping ring. While rigid upper stripping members 128 are depicted in FIGS. 2-9, it is within the scope of the present disclosure to provide non-rigid upper stripping members 128. Examples of suitable non-rigid upper stripping members include lengths of cord, cable or metal chain. The advantage derived from the use of such materials is the provision of greater stalk conforming contact, which leads to enhanced leaf stripping ability. As the stalk is conveyed each stripping ring wraps about stalk S and is effective to tear the leaves of the agricultural product from stalk S.

As is the case of a tobacco plant, the leaves along stalk S have different properties owing to the amount of sun each may receive and may also differ in size, with the largest leaves forming along the bottom of the plant. Advantageously, apparatus 10 may also include a plurality of dividers 58 perpendicularly disposed along first and second longitudinal members 14 and 20, the plurality of dividers 58 effective to sort leaves by position along the stalk S. To better sort leaves by position along stalk S, one or more of the plurality of cross members 26 may be made to be longitudinally positionable along first and/or second longitudinal members 14 and/or 20 through the use of clamping mechanisms 60.

In another form, provided is a method for stripping and sorting leaves from stalks of agricultural crops. The method includes the steps of placing a stalk upon a plurality of lower stripping members of an apparatus for stripping and sorting leaves from the stalks of agricultural crops, positioning a plurality of upper stripping members so as to cooperate with a corresponding lower stripping member to substantially encircle the stalk, engaging and conveying the stalk longitudinally along the apparatus, stripping the leaves from the stalk as the stalk is conveyed along the apparatus, and sorting the leaves by position along the stalk as the stalk is conveyed along the apparatus.

Referring again to FIGS. 2-9, in operation, an operator O acquires a tobacco stalk S from a bulk supply. Operator O then places stalk S, with tip T facing the stalk gripping assembly 140, onto the plurality of lower stripping members 128. Operator O pulls downward on spring loaded bar 178 of pivotable frame 132. During this downward move, the upper stripping members pivot down and wrap around stalk S.

Figure 2:
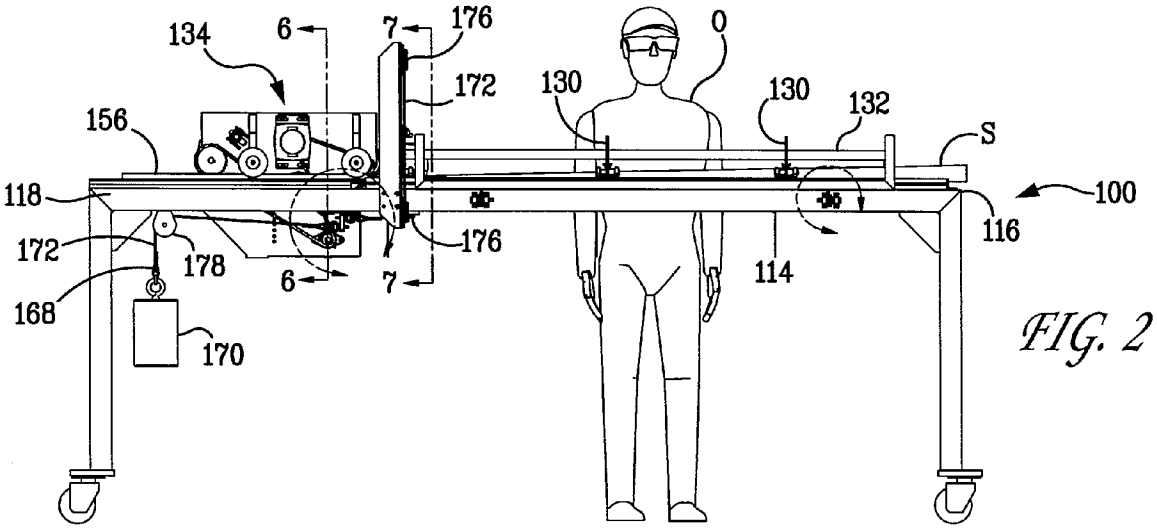
FIG. 2 presents a side view of one form of an apparatus for stripping and sorting leaves from the stalks of agricultural crops, in accordance herewith.

Also during this move, the means for engaging and conveying 134 will traverse a distance, which may be six to 18 inches, or 9 to 15 inches or approximately 12 inches, toward the stalk S. Referring to FIGS. 2 and 7, this movement is accomplished through the use of a weighted cable and pulley system 168. A cable 172 is anchored at anchoring point 174 and traverses a plurality of pulleys 176 operatively connected to engaging and conveying means 134. Weight 170 is suspended from the non-anchored end of cable 172 and travels vertically over pulley 178. As shown in FIG. 2, pulley 178 is mounted to longitudinal member 114 near second end 118.

As engaging and conveying means 134 moves toward the stalk S, the tip leaves are drawn into the nip point N. The stalk gripping assembly 140 formed by first V-belt driven wheel 136 and second V-belt driven wheel 138 removes the tip leaves and pulls the stalk S through the stripper rings formed by upper stripping member 130 and its corresponding lower stripping member 128. The tip leaves are pulled off at the end of the engaging and conveying means 134 and fall into a bin (not shown).

As the stalk S is pulled through the apparatus 100 a set of secondary splined drive wheels 146 and 148 engage stalk S just after the stalk gripping assembly 140 to ensure the stalk is completely removed from the apparatus 100. As with the form depicted in FIG. 1, stripped leaves fall between adjustable dividers located below the stripping rings and may serve to grade the tobacco. These dividers can be adjusted to accommodate any size tobacco crop. Leaf collection bins can be easily slipped under the apparatus 100 and can accommodate variable size containers. Stalk S next exits the apparatus 100 and may simply fall to the floor.

In accordance herewith, the apparatus for stripping and sorting leaves from stalks of agricultural crops can accommodate the processing of up to 9000 stalks/day or more, or 3000 pounds per day of tobacco. This is equivalent to a processing rate of about 16 ft/min.

While the present inventions have been described in connection with a number of exemplary forms, and implementations, the present inventions are not so limited, but rather cover various modifications, and equivalent arrangements, which fall within the purview of the present claims.

What is claimed:

1. An apparatus for stripping and sorting leaves from stalks of agricultural crops, comprising (a) a base frame having a first longitudinal member, said first longitudinal member having a first end and a second end, and a second longitudinal member in a parallel spaced-relationship with said first longitudinal member;

(b) a plurality of cross members arranged perpendicularly along at least said first longitudinal member, each of said plurality of cross members having a lower stripping member for receiving the stalk of an agricultural crop;

(c) a plurality of upper stripping members, each upper stripping member positionable to cooperate with a corresponding lower stripping member to substantially encircle the stalk;

(d) means for engaging and conveying the stalk along the apparatus in a direction from said first end to said second end of said first longitudinal member; and (e) a pivotable frame, said pivotable frame having said plurality of upper stripping members affixed thereto;

wherein each upper stripping member and the corresponding lower stripping member cooperate to strip the leaves from the stalk as the stalk is conveyed along the apparatus, and wherein said means for engaging and conveying the stalk along the apparatus comprises a stalk gripping assembly disposed near said second end of said first longitudinal member.

2. An apparatus for stripping and sorting leaves from stalks of agricultural crops, comprising (a) a base frame having a first longitudinal member, said first longitudinal member having a first end and a second end, and a second longitudinal member in a parallel spaced-relationship with said first longitudinal member;

(b) a plurality of cross members arranged perpendicularly along at least said first longitudinal member, each of said plurality of cross members having a lower stripping member for receiving the stalk of an agricultural crop;

(c) a plurality of upper stripping members, each upper stripping member positionable to cooperate with a corresponding lower stripping member to substantially encircle the stalk; and (d) means for engaging and conveying the stalk along the apparatus in a direction from said first end to said second end of said first longitudinal member;

wherein each upper stripping member and the corresponding lower stripping member cooperate to strip the leaves from the stalk as the stalk is conveyed along the apparatus, and wherein said means for engaging and conveying the stalk along the apparatus comprises a stalk gripping assembly disposed near said second end of said first longitudinal member, said stalk gripping assembly including cooperative first and second drive belts disposed in a side-by-side relationship to form a v-configuration.

3. The apparatus of claim 2, wherein respective innermost segments of the belts are disposed adjacent each other to cooperate and receive the stalk therebetween.

4. The apparatus of claim 3, further comprising a pair of splined rollers for receive the tip of the stalk therebetween.

5. The apparatus of claim 3, further comprising a conveyor assembly disposed near said second end of said first longitudinal member, said conveyer assembly comprising a pair of rollers and an endless belt operatively encircling said rollers, said conveyor assembly connected to said base frame and effective to convey the stalk parallel to said first longitudinal member.

6. The apparatus of claim 1, further comprising a conveyor assembly disposed near said second end of said first longitudinal member, said conveyer assembly comprising a pair of rollers and an endless belt operatively encircling said rollers, said conveyor assembly connected to said base frame and effective to convey the stalk parallel to said second end of said first longitudinal member.

7. The apparatus of claim 1, wherein said pivotable frame pivots from an open position to a closed position.

8. The apparatus of claim 7, wherein said means for engaging and conveying the stalk along the apparatus is initiated by placing said pivotable frame in said closed position.

9. The apparatus of claim 1, further comprising a plurality of dividers perpendicularly disposed along said first and second longitudinal members, said plurality of dividers effective to sort leaves by position along the stalk.

10. A method for stripping and sorting leaves from stalks of agricultural crops, the method comprising:

(a) placing a stalk upon a plurality of lower stripping members of an apparatus for stripping and sorting leaves from the stalks of agricultural crops;

(b) positioning a plurality of upper stripping members so as to cooperate with a corresponding lower stripping member to substantially encircle the stalk;

(c) engaging and conveying the stalk longitudinally along the apparatus;

(d) stripping the leaves from the stalk as the stalk is conveyed along the apparatus; and (e) sorting the leaves by position along the stalk as the stalk is conveyed along the apparatus, wherein the apparatus includes (i) a base frame having a first longitudinal member, the first longitudinal member having a first end and a second end, and a second longitudinal member in a parallel spaced-relationship with the first longitudinal member; (ii) a plurality of cross members arranged perpendicularly along at least the first longitudinal member, each of the plurality of cross members having one of the plurality of lower stripping members; (iii) the plurality of upper stripping members; (iv) means for engaging and conveying the stalk along the apparatus in a direction from the first end to the second end of the first longitudinal member; and (v) a pivotable frame, the pivotable frame having the plurality of upper stripping members affixed thereto; wherein each upper stripping member and the corresponding lower stripping member cooperate to strip the leaves from the stalk as the stalk is conveyed along the apparatus, and wherein the means for engaging and conveying the stalk along the apparatus includes a stalk gripping assembly disposed near the second end of the first longitudinal member.

11. A method for stripping and sorting leaves from stalks of agricultural crops, the method comprising:

(a) placing a stalk upon a plurality of lower stripping members of an apparatus for stripping and sorting leaves from the stalks of agricultural crops;

(b) positioning a plurality of upper stripping members so as to cooperate with a corresponding lower stripping member to substantially encircle the stalk;

(c) engaging and conveying the stalk longitudinally along the apparatus;

(d) stripping the leaves from the stalk as the stalk is conveyed along the apparatus; and (e) sorting the leaves by position along the stalk as the stalk is conveyed along the apparatus, wherein the apparatus includes (i) a base frame having a first longitudinal member, the first longitudinal member having a first end and a second end, and a second longitudinal member in a parallel spaced-relationship with the first longitudinal member; (ii) a plurality of cross members arranged perpendicularly along at least the first longitudinal member, each of the plurality of cross members having one of the plurality of lower stripping members; (iii) the plurality of upper stripping members; and (iv) means for engaging and conveying the stalk along the apparatus in a direction from the first end to the second end of the first longitudinal member; wherein each upper stripping member and the corresponding lower stripping member cooperate to strip the leaves from the stalk as the stalk is conveyed along the apparatus, and wherein the means for engaging and conveying the stalk along the apparatus includes a stalk gripping assembly disposed near the second end of the first longitudinal member, the stalk gripping assembly including cooperative first and second drive belts disposed in a side-by-side relationship to form a v-configuration.

12. The method of claim 11, wherein respective innermost segments of the belts are disposed adjacent each other to cooperate and receive the stalk therebetween.

13. The method of claim 12, further comprising a pair of splined rollers to receive the tip of the stalk therebetween.

14. The method of claim 10, further comprising a conveyor assembly disposed near the second end of the first longitudinal member, the conveyer assembly comprising a pair of rollers and an endless belt operatively encircling the rollers, the conveyor assembly connected to the base frame and effective to convey the stalk parallel to the first longitudinal member.

15. The method of claim 10, wherein the pivotable frame pivots from an open position to a closed position.

16. The method of claim 15, wherein the means for engaging and conveying the stalk along the apparatus is initiated by placing the pivotable frame in the closed position.

17. The method of claim 10, further comprising a plurality of dividers perpendicularly disposed along the first and second longitudinal members, the plurality of dividers effective to sort leaves by position along the stalk.

* * * * *